United States Patent [19]

Morris et al.

[11] 4,011,429

[45] Mar. 8, 1977

[54] HOT STRETCH-WRAP FORMING WITH RESISTANCE HEATING

[75] Inventors: Carl M. Morris, Manhattan Beach; William E. Manchester, Lomita; John L. Hill, Redondo Beach; Robert A. Bridwell, Buena Park; Douglas B. Hugill, Hermosa Beach, all of Calif.

[73] Assignee: Northrop Corporation, Los Angeles, Calif.

[22] Filed: Oct. 20, 1975

[21] Appl. No.: 624,117

[52] U.S. Cl. ..... 219/153; 72/297; 72/342; 219/151

[51] Int. Cl.[2] ..... B21J 13/08; H05B 3/26

[58] Field of Search ..... 72/296, 297, 342; 219/50, 117 HD, 149, 150 R, 151, 152, 153, 154, 162

[56] References Cited

UNITED STATES PATENTS

| | | | |
|---|---|---|---|
| 1,112,779 | 10/1914 | Forsyth | 219/149 |
| 1,251,578 | 1/1918 | Riecken | 219/149 |
| 2,905,225 | 9/1959 | Lalli | 72/297 X |
| 2,952,767 | 9/1960 | Maloney | 219/149 |
| 3,021,887 | 2/1962 | Maynard | 219/153 X |
| 3,933,020 | 1/1976 | Orr et al. | 72/342 X |

*Primary Examiner*—Bruce A. Reynolds
*Assistant Examiner*—N. D. Herkamp
*Attorney, Agent, or Firm*—William W. Rundle; Willard M. Graham

[57] ABSTRACT

Stretch-wrap forming of titanium parts or the like by resistance heating the part and a steel forming element which is cast into a fused silica die insert. Heating is accomplished by an electrical circuit in which both the part and the element are connected in parallel. The part is stretch wrapped over the element while a low voltage, high amperage current is allowed to flow through both the part and the element.

6 Claims, 3 Drawing Figures

HOT STRETCH-WRAP FORMING WITH RESISTANCE HEATING

BACKGROUND OF THE INVENTION

The present invention relates to hot stretch-wrap forming of metal parts and more particularly to the stretch-wrap forming of elongated metal parts such as sheet stock, extrusions and preshaped parts which are normally extremely difficult to stretch-wrap form and when made of titanium, titanium alloys and similar metal require heating of the part to its forming temperature (up to 1,500° F) before satisfactory results can be obtained.

Stretch-wrap forming of flat, hat sections, joggle section, etc. without heating the part to its forming temperature often results only in bending of the part with the stresses on the convexed section of the part often exceeding the elastic limits of the part and the concaved section of the part often being in contraction resulting in a tension failure in the convexed section, a wrinkled concaved section, or both.

In the prior art only flat workpieces have been formed by hot stretch forming and the methods of heating have been limited to heating by heat lamps of imbedding heater units in the forming die. The amount of power required to heat the die and the part combined with the complexity of the heating devices make the prior art methods and devices impractical, particularly for hot stretch-wrap forming of titanium and similar metals.

BRIEF SUMMARY OF THE INVENTION

We have found that to properly stretch-wrap form parts by resistance heating, the temperature of the die forming element must be uniform and maintained at the forming temperatures of the part to be stretch-wrap formed throughout the forming operation. To achieve this by resistance heating it is necessary, in most cases, that the forming element be nonuniform in cross section to assure a proper distribution of heating. The various thickness of the element must be designed to provide the required heating bias to compensate for differences in radiation losses and electrical path length due to the overall element shape, and it is essential that the part be connected in a parallel circuit with the forming element. It is this feature that makes it possible to maintain resistance heating power throughout the forming cycle. If the part were not in a parallel circuit, a shunting effect would occur between the forming element and the part as they contacted each other, and local overheating would result.

Satisfactory functioning of the system also depends on proper proportioning of the heating effect between the forming element and the part when it is in position, prior to stretch wrapping. During this phase of preheating, the relative electrical resistance of the element, the jaws of the stretch press and the part control a proportionate heating effect assuring that the forming element will obtain the forming temperature of the part and the part will, at the same time, be preheated to a temperature substantially below its forming temperature so that the noncontacting portion of the part has higher yield strength than that portion which is in contact with the forming element while the forming cycle is progressing. Accordingly it is an object of the present invention to provide a method and apparatus for hot stretch-wrap forming preformed or preshaped parts having an irregular cross section, as well as flat sheet stock.

Another object is a means for uniformly resistance heating a forming element of a die and maintaining the proper heat throughout the stretch-wrap cycle.

A further object is to provide a method of resistance heating both the part and forming element by a parallel electric circuit.

Still another objective is to present the details of the construction of the die used in practicing the invention. These and other objectives of our invention will become apparent to those skilled in the art as the description thereof proceeds. The invention may be more fully understood by reference to the figures and the following detailed description.

DETAILED DESCRIPTION OF THE INVENTION

Figure 1:
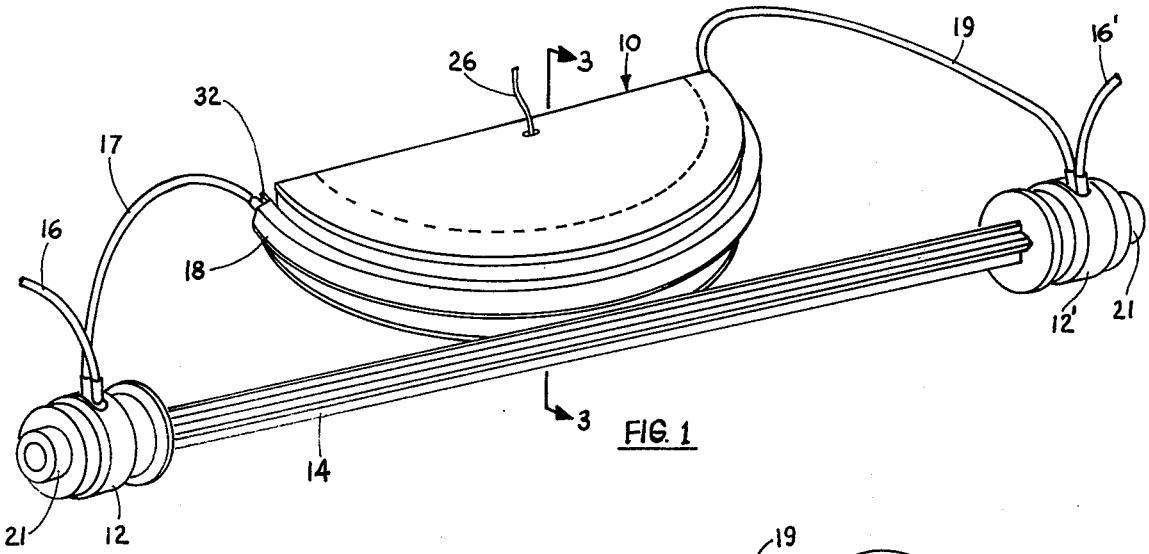
FIG. 1 is a front perspective view illustrating the relationship of a preformed part to the die prior to stretch-wrap forming.
Figure 2:
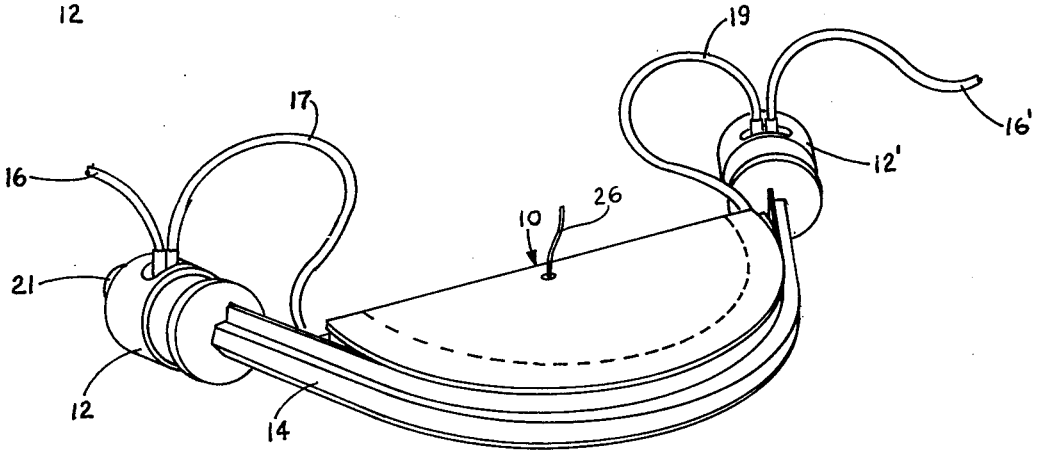
FIG. 2 is a front perspective view illustrating the relationship of the preformed part to the die after the preformed part has been stretch-wrap formed.
Figure 3:
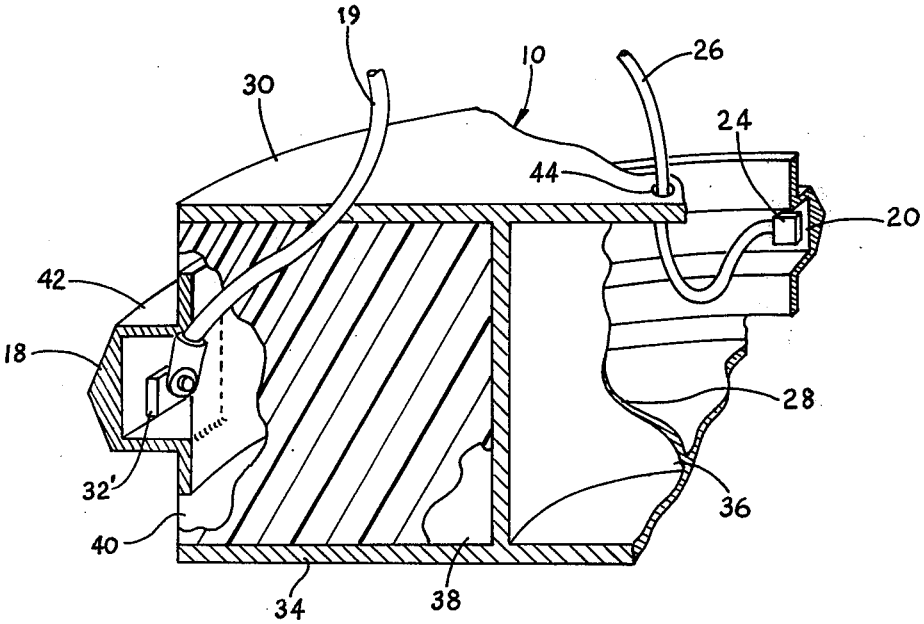
FIG. 3 is a rear fragmentary perspective view, partly in cross-section, of the die shown as indicated by the line 3—3 in FIG. 1 and illustrates one configuration of a die used in practicing the present invention.

Referring more specifically to the drawings in FIG. 1 we have illustrated a die assembly 10, a pair of opposing jaws 12 and 12' of a standard stretch press (not shown), a preformed straight part 14 having a hat-shaped cross section, for example, held by the jaws 12 and 12' and connected in a parallel electrical circuit with a forming element 18 by an electrical cable 16 which is connected to jaw 12 and by a jumper cable 17 which connects the jaw 12 to forming element 18 by means of an attaching bar 32 welded to one end of the forming elements 18, allowing current to flow in parallel through the element 18 and the preformed part 14 and to return to a power source (not shown) by means of an attaching bar 32' welded to the other end of the forming element 18, through return cable 19 to the jaw 12' and through the cable 16' which connects the jaw 12' to the power source. It should be noted that any standard stretch press can be modified to practice the present invention. The only modification required are that the jaws of the press be electrically isolated from the press, such as by mounting on an insulator collar 21, and that provision can be made on each jaw to removably attach electrical cable assembly 16 and 16' A die built according to the present teaching can be mounted in the press in the customary manner. Also shown in FIG. 1 is a wire 26 which is connected to a temperature sensing means 24, as best shown in FIG. 3. In FIG. 2 we have shown the position of the preformed part 14 relative to the die 10, after being stretch-wrap formed to a curved shape around the forming element 18.

FIG. 3 illustrates die 10 as viewed from the rear along line 3—3 of FIG. 1. As illustrated in FIG. 3 the forming element 18 includes the attaching bar 32' welded to the end of element 18. The identical attaching bar 32 is welded to the other end of element 18 (shown in FIG. 1).

The purpose of attaching bars 32 and 32' is to provide a means for removably connecting cables 17 and 19 to the respective ends of element 18. Temperature sensing means 24 is fixed to an inside surface 20 of element 18 and the wire 26 extends from the sensing means 24 for connecting a temperature recording device (not shown). The die 10 consists of a steel cage 28 which comprises a top plate 30, a bottom plate 34 and a supporting plate 36 which is welded to the top plate 30 and the bottom plate 34 respectively, holding them in a spaced relationship, and forming a cavity 38 in which a high temperature-resistance dielectric insert 40 is cast, holding element 18 embedded in place with the outside surface 42 of the element 18 exposed. A hole 44 is provided in the top plate 30 and the wire 26 is fed through the hole 44 prior to casting the element 18 in place. In manufacturing the die for the present invention the insert 40 was cast from fused silica; however there are many tyes of ceramic materials available which are adequate for this function. It will be understood that the die described herein can be modified considerably without departing from the invention. We do not wish to be limited to the specific details or hat-section shape of forming element herein set forth but wish to reserve to ourselves any variations or modifications that appear to those skilled in the art and fall within the scope of the claims.

MODE OF OPERATION OF INVENTION

The operation of the invention is as follows: The die 10 is secured to a standard stretch press (not shown) for normal stretch forming operation. The cable 16 extending from a low voltage power source (not shown) is connected to the jaw 12 and the jumper cable 17 is connected from the jaw 12 to the attaching bar 32 located at one end of the element 18. One end of the return cable 19 is attached to the attaching bar 32′, located at the other end of the element 18, and the other end of the return cable 19 is attached to jaw 12′. One end of the cable 16′ is connected to the jaw 12′ and its other end is connected to the power source. The part 14 is inserted into and removably held by the jaws 12 and 12′ completing a parallel electrical circuit. The power source is turned on and set to heat the element 18 to the forming temperature of the part 14. When the recording device indicates that the element 18 is at the forming temperature of the part 14, the stretch press is set into operation bringing part 14 into contact with element 18 and stretch-wrap forming part 14 around die 10 as shown in FIG. 2. During the stretch-wrapping, the part 14 is brought up to its forming temperature by contact with forming element 18, and no arcing or electrical short-circuiting occurs. The current flowing through element 18 and part 14 is then turned off and the part allowed to cool to about 200° below its forming temperature, as indicated by the temperature recording device. The curved formed part is then removed from jaws 12 and 12′.

What is claimed is:

1. The process of stretch-wrap forming an elongated metal part or the like, particularly a part having an irregular cross section, on a stretch press having a pair of opposing jaws, comprising:

a. positioning a die assembly on said stretch press, said die having a heat-resistant electrical insulating insert in which an elongated forming element is mounted, the cross section of said forming element being capable of maintaining uniform electrical resistance heating when said process is in operation.

b. positioning a part in the jaws of said stretch press, said jaw as being electrically isolated from said stretch press, c. passing a heating current in parallel through said forming element and said part, d. bringing said part in contact with said element when said element is uniformly heated to the forming temperature of said part, e. stretch-wrap forming said part around said element of said die, f. stopping said current and holding the formed part in mating relationship with said element until said part has dropped to a desired temperature below said forming temperature, and g. removing said formed part from said jaws.

2. Method in accordance with claim 1 wherein said part is heated by said heating current passing through said part only to a temperature substantially below its forming temperature before contact with said forming element.

3. A die for having metal parts and the like formed thereon, comprising:

a. a cage having a cavity therein, b. a high temperature-resistant dielectric insert cast into said cavity, c. a curved, elongated metal-forming element supported in said insert with a metal forming portion of said forming element exposed, d. said forming element having an irregular and non-uniform cross section thicker in the center of said cross section than at the edges thereof, whereby said forming element is configured to heat uniformly when a current is passed therethrough, and e. means for passing a heating electric current through said forming element from one end to the other.

4. A die in accordance with claim 3 wherein said cage is made from metal.

5. A die in accordance with claim 3 wherein a temperature sensing means is attached to an inside surface of said forming element.

6. Means for stretch-wrap forming a preshaped metal part in a stretch press, comprising:

a. a die-assembly for securing in a stretch press, said die assembly having an elongated metal forming element supported thereon by means electrically insulating said forming element from said assembly and from said press, said forming element having an outer surface shaped and positioned to have said part stretch-wrapped against it, the cross section of said forming element being of non-uniform thickness to heat uniformly when an electric current is passed through said forming element from end to end;

b. a pair of movable jaws for holding the ends of the part to be formed, said jaws being electrically insulated from said press and from ground;

c. first electrical cable means connected from one of said jaws to one, adjacent, end of said forming element;

d. second electrical cable means connected from the other said jaw to the other end of said forming element; and e. means for connecting said first and second cable means respectively to opposite sides of an electrical power source; whereby said part and said forming element are connected in parallel for heating while said part is being formed.

* * * * *